US005743385A

United States Patent [19]

Godesa

[11] Patent Number: 5,743,385

[45] Date of Patent: Apr. 28, 1998

[54] DRIVE DEVICE WITH A LOCKING DEVICE TO PREVENT SWITCH SHAFT REBOUND

[75] Inventor: Ludvik Godesa, Berlin, Germany

[73] Assignee: Siemens Aktiengesellschaft, Munich, Germany

[21] Appl. No.: 727,502

[22] PCT Filed: Apr. 10, 1995

[86] PCT No.: PCT/DE95/00494

§ 371 Date: Feb. 5, 1997

§ 102(e) Date: Feb. 5, 1997

[87] PCT Pub. No.: WO95/29499

PCT Pub. Date: Nov. 2, 1995

[30] Foreign Application Priority Data

Apr. 20, 1994 [DE] Germany ..... 4416091.7

[51] Int. Cl.[6] ..... H01H 23/00

[52] U.S. Cl. ..... 200/401; 200/400

[58] Field of Search ..... 200/400, 401, 200/DIG. 42, 718

[56] References Cited

U.S. PATENT DOCUMENTS

| | | | |
|---|---|---|---|
| 4,468,553 | 8/1984 | Kodera et al. . | |
| 5,226,528 | 7/1993 | Schaffer et al. | 200/400 |
| 5,310,971 | 5/1994 | Vial et al. | 200/400 |
| 5,486,667 | 1/1996 | Castonguay et al. | 200/400 |
| 5,571,255 | 11/1996 | Baginski et al. | 200/400 |

FOREIGN PATENT DOCUMENTS

| | | |
|---|---|---|
| 0089 463 | 9/1983 | European Pat. Off. . |
| 1096168 | 6/1955 | France . |

*Primary Examiner*—David J. Walczak
*Attorney, Agent, or Firm*—Kenyon & Kenyon

[57] ABSTRACT

A locking device is fitted in a drive device of a power switch to prevent the switch shaft from rebounding from its off position. The locking device (6) comprises a retainer (7) on the switch shaft (1) and a clamp (10) pivotable about a fixed bearing. The clamp (10) has an arc-shaped aperture to engage with the retainer (7) with considerable overlaps. The clamp (10) is actuated by a working surface on the retainer (7) so that its aperture (17) engages over the retainer (7).

7 Claims, 1 Drawing Sheet

DRIVE DEVICE WITH A LOCKING DEVICE TO PREVENT SWITCH SHAFT REBOUND

FIELD OF THE INVENTION

The invention relates to a drive device of a power switch having a switch shaft in common for several poles, the switch shaft being able to be acted upon in the switching-on sense by means of a spring energy store via toggle levers on one hand, and on the other hand by pole-side breaking forces in the switching-off sense. A mechanical locking device is provided as protection against a rebound of the switch shaft out of its final position upon switching off.

BACKGROUND OF THE INVENTION

A drive device of this type is disclosed in U.S. Pat. No. 4,468,533. In that case, the locking device comprises a hooklike lever whose hooklike region arrives near a fixed bolt upon switching off and engages over it. The hooklike lever, supported on a lever located on the switch shaft, is acted upon by a resetting spring which draws the hooklike lever back again and again establishes the normal movability of the switch shaft.

The bounce of the switch shaft upon reaching the off position is dependent on a number of different factors. Of importance in this connection are not only the mechanical properties of the moved parts, i.e., their mass, their elastic deformation caused by the forces occurring and their velocity, but also the current that is to be interrupted in each case by the switching contacts of the power switch and from which an electrodynamic effect emanates upon the moved parts. That is why it causes considerable difficulty to design the mentioned locking device in such a way that it controls the bounce within the entire power range of a power switch, i.e., from normal operating currents to the greatest short-circuit currents. For example, a locking device of the type indicated can be effective given a certain switching current, however neither in the case of a lower nor in the case of a higher current.

OBJECTS AND SUMMARY OF THE INVENTION

An object of this invention is to design a locking device of the type named at the outset in such a way that it is effective regardless of the strength of the switching operation.

This objective is achieved according to the invention in that at least one retainer is secured on the switch shaft and that the clamp is arranged in a manner that it is pivotable about a fixed bearing, the retainer having a working surface for acting upon the clamp in the sense of a grasping of the retainer. This arrangement can be utilized regardless of the levers that are located on the switch shaft and by means of which the driving forces are introduced into the switch shaft and passed on from it. Therefore the locking device formed by the clamp must be mounted at a suitable location and, given suitable dimensioning, is also usable repeatedly if necessary.

In one advantageous refinement of the invention, the clamp can be designed with an aperture open on one side having a curved arcuate outer wall adapted to the retainer and an overlapping between the retainer and the clamp can be dimensioned to be considerably larger than is necessary to block the switch shaft from turning back. In this manner the operating range of the locking device is considerably enlarged because the clamp can engage for a variable distance over the retainer without a limit stop in a final position which could impair the effectiveness of the device.

The aperture of the clamp can have a curved end wall, while the retainer has a straight end border. A beneficial consequence of this structural arrangement is that a reflection of the clamp due to bounce does not happen even when the overlapping between the retainer and the clamp is completely passed through and the clamp bumps with the end face of its aperture against the end of the retainer.

As a further advantageous measure for expanding the operating range of the locking device, two identical arrangements composed of retainer and clamp can be arranged at the switch shaft and the resetting springs of the two clamps can be designed with different strengths.

It is beneficial for the effectiveness of the locking device described if the retainer is supported near a bearing which is as load-bearing as possible. This can be achieved in particular in the case of the arrangement having two retainers and clamps because the two clamps are arranged symmetrically to two bearing plates which accommodate the toggle levers between themselves and on which shaft bearings for the switch shaft are located. The clamps can hereby be supported on a bearing bolt that joins the bearing plates, projects beyond the bearing plates and at the same time forms a stop means for the off-position of the switch shaft.

BRIEF DESCRIPTION OF THE FIGURES

In the following the invention is explained more precisely with the aid of the exemplary embodiment depicted in the figures.

DETAILED DESCRIPTION OF THE INVENTION

Figure 1:
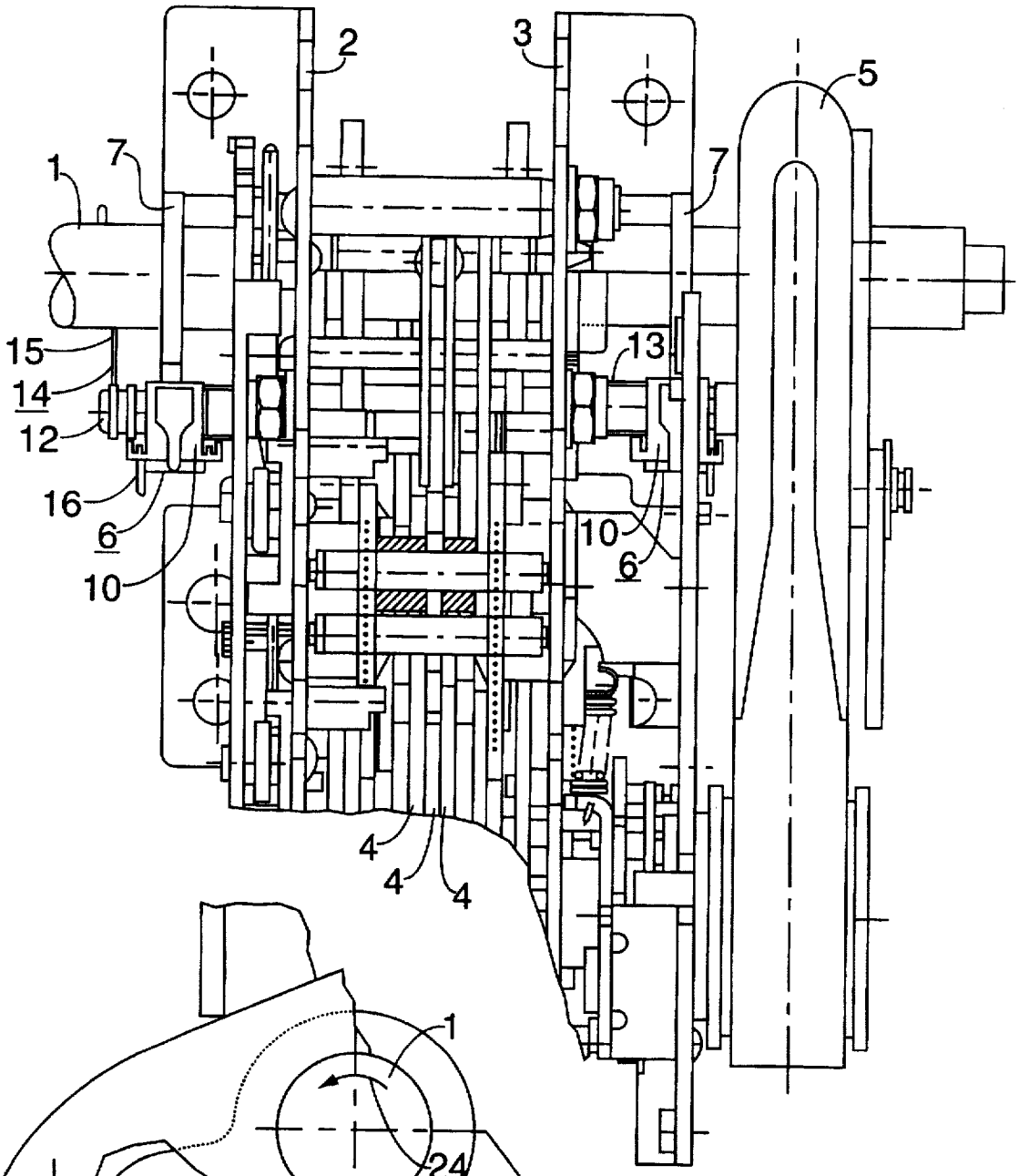
FIG. 1 shows a switch shaft of a low-voltage power switch with adjacent parts of a drive device having two locking devices to prevent a bounce of the switch shaft.

The switch shaft 1 shown in the figures is supported on two bearing plates 2 and 3 which are arranged parallel to one another and are rigidly interconnected. The bearing plates 2 and 3 accommodate a lever arrangement between themselves, a part of which are, in particular, toggle levers 4 transmitting a driving force to the switch shaft. A spring energy store not visible in the figures arranged between the bearing plates 2 and 3 is tensible by means of a hand lever 5 arranged at the side of the bearing plate 3. The parts used for latching the spring energy store in the taut state as well as for transmitting the spring energy to the switch shaft and from there to the switching contacts are generally known in the case of low-voltage power switches and therefore are not described more precisely in the present context.

Two locking devices are provided as the locking device against a turn-back of the switch shaft 1 in the direction of the closed position of the switching contacts after the switch shaft has reached its final position in the course of switching off. The two locking devices, being collectively designated with the number 6 are arranged symmetrically with respect to the bearing plates 2 and 3. Each of the locking devices 6 comprises a retainer 7 located on the switch shaft 1 and having a shape which is clear from FIG. 2. Furthermore, a clamp 10 is a part of each of the locking devices 6 whose design can likewise be seen more precisely from FIG. 2. As is shown in the Figures, the retainer 7 exhibits a curved contour with an essentially straight end border 11. The clamp 10 is swing-mounted on the protruding end section 12 of a bearing bolt 13 joining the bearing plates 2 and 3. Serving as a resetting spring 14 is a wire torsion spring whose one leg 15 abuts against the switch shaft 1 and whose other leg 16 abuts against the clamp 10, the windings likewise surrounding the protruding end section 12 of the bearing bolt 13. The clamp 10 has an aperture 17 that is open on one side having a curved outer wall 20 which is adapted to the contour of the retainer 7. However, a curved end wall 21 of the aperture 17 is different, which rules out a surface contact of the end of the retainer 7 with the clamp 10.

Moreover, the retainer 7 has a working surface 22 which interacts with an extension prolongation 23 opposite the aperture 17 relative to the axis of rotation of the clamp 10.

Figure 2:
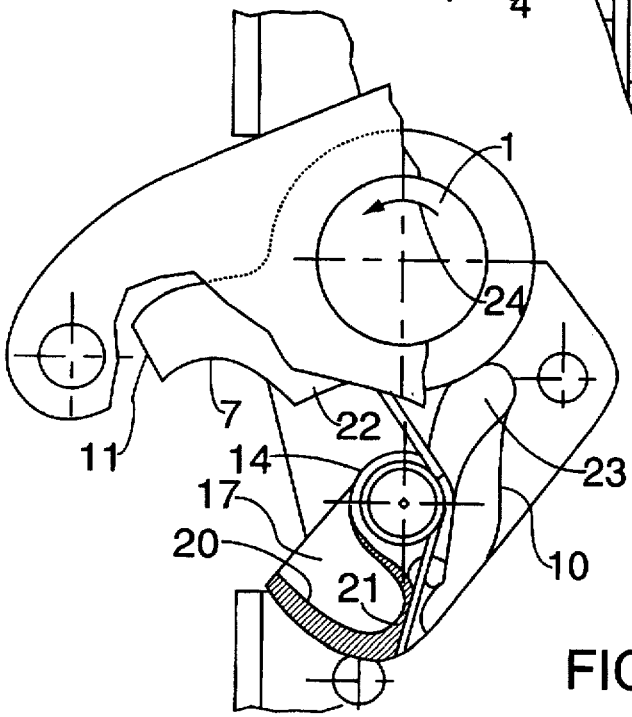
In FIG. 2 one of the locking devices depicted in FIG. 1 is shown in a side view on a larger scale.

In FIG. 2 the locking device is shown in the idle state in which the switch shaft 1 is arbitrarily rotatable between its final positions. Upon switching off, the switch shaft 1 executes a rotation in the direction of the arrow 24 shown in FIG. 2. In so doing, the working surface 22 of the retainer 7 strikes against the extension prolongation 23 of the clamp 10 and causes the clamp 10, against the force of the resetting spring 14, to turn contrary to the direction of rotation of the switch shaft 1. Consequently the end border 11 and the aperture 17 move toward each other. The distance by which the clamp 10 with its aperture 17 engages over the retainer 7 varies depending on the strength of the impact of the working surface 22 on the extension prolongation 23. As soon as a certain overlapping is achieved between these parts, the switch shaft 1 cannot rebound. Only after the bouncing occurrence dies down does the clamp 10 return to the original position shown and again release the retainer 7. This operation is effective within a considerable range of forces to which the switch shaft is exposed during the different switching operations. At the same time, the clamp 10 always remains engaged a certain time with the retainer 7 because, as a rule, a radial collision of the retainer 7 and the clamp 10 does not take place, and thus the clamp 10 cannot be thrown back prematurely due to bounce. Even when, in response to a particularly violent impact, the end border 11 of the retainer 7 makes contact against the end wall 21, this does not result in a rebound because, on account of the chosen shape of the parts, impact forces come about acting predominantly in the direction of the bearing assembly of the clamp 10.

As has been noted, one retainer 7 and one clamp 10 each is arranged on either side of the bearing plates 2 and 3. Just the strength of the resetting spring 14 is variable, which means the one of the devices is effective given lower speeds of the switching-off operation and the other device is effective in the case of greater speeds of the switching-off operation.

I claim:

1. A drive device for a multi-pole power switch comprising:

a switch shaft in common for several poles;

toggle levers configured for linkage with a spring energy store for actuating the shaft for a power on sense and utilizing pole-side breaking forces for a power off sense;

a resetting spring;

a fixed bearing;

at least one retainer that is secured to the switch shaft;

a clamp that is pivotable about the fixed bearing, said clamp being actuatable by the retainer for protection against rebounding of the switch shaft from its final position upon power off, wherein the retainer has a working surface for cooperation with the clamp so as to form a connection therewith; and wherein the clamp has an aperture open on one side and a curved outer wall portion which is adapted to cooperate with the retainer, and wherein the retainer and the clamp are configured with a degree of overlapping upon juxtaposition with one another so that the overlapping between the retainer and the clamp is dimensioned to be considerably larger than is necessary to block the switch shaft from turning back.

2. A drive device as set forth in claim 1, wherein the aperture of the clamp has a curved end wall and the retainer has a straight end border.

3. A drive device as set forth in claim 2, wherein two identical arrangements composed of a retainer and a clamp and a resetting spring are arranged at the switch shaft and the resetting springs of the two clamps are configured with different strengths.

4. A drive device for a multi-pole power switch comprising:

a switch shaft in common for several poles;

toggle levers configured for linkage with a spring energy store for actuating the shaft for a power on sense and utilizing pole-side breaking forces for a power off sense;

a resetting spring;

a fixed bearing;

at least one retainer that is secured to the switch shaft;

a clamp that is pivotable about the fixed bearing, said clamp being actuatable by the retainer for protection against rebounding of the switch shaft from its final position upon power off, wherein the retainer has a working surface for cooperation with the clamp so as to form a connection therewith; and wherein two identical arrangements composed of a retainer, a clamp, and a resetting spring are arranged at the switch shaft and the resetting springs of the two clamps are configured with different strengths.

5. A drive device as set forth in claim 4, further comprising two bearing plates, and wherein the two clamps are arranged symmetrically with respect to the two bearing plates, the toggle levers being located between the bearing plates which provide a bearing surface for the switch shaft.

6. A drive device as set forth in claim 5 wherein said clamps are supported on said fixed bearing wherein said fixed bearing includes a bearing bolt which joins the bearing plates and wherein said clamps protrude beyond the bearing plates and wherein said clamps are rotationally mounted onto the portion of the bolt that protrudes from the bearing plates and provide a stop means for the off position of the switch shaft.

7. A drive device as set forth in claim 1, wherein two identical arrangements composed of a retainer and a clamp and a resetting spring are arranged at the switch shaft and the resetting springs of the two clamps are configured with different strengths.

* * * * *